US005569167A

United States Patent [19]

Friedli

[11] Patent Number: 5,569,167

[45] Date of Patent: Oct. 29, 1996

[54] REHABILITATION APPARATUS IN COMBINATION WITH A MOTOR-DRIVEN VEHICLE

[76] Inventor: Faye E. Friedli, Route 1, Box 19, York, Nebr. 68467

[21] Appl. No.: 412,298

[22] Filed: Mar. 28, 1995

[51] Int. Cl.[6] ..... A61H 3/00

[52] U.S. Cl. ..... 601/23; 482/51; 482/68

[58] Field of Search ..... 280/1.5, 7.17, 280/788.4; 601/23, 33–35; 482/51, 74, 68, 69, 131; 135/67; 224/309, 310, 322; 414/921; 296/3, 7

[56] References Cited

U.S. PATENT DOCUMENTS

| | | | |
|---|---|---|---|
| 329,989 | 11/1895 | Woodworth | 482/69 |
| 2,650,725 | 9/1953 | Hoyer et al. | 414/921 |
| 4,826,387 | 5/1989 | Audet | 224/310 |
| 5,033,409 | 7/1991 | Sabot | 280/288.4 |
| 5,154,563 | 10/1992 | Philips | 414/921 |
| 5,255,951 | 10/1993 | Moore, III | 296/3 |
| 5,360,150 | 11/1994 | Praz | 224/310 |

FOREIGN PATENT DOCUMENTS

| | | | |
|---|---|---|---|
| 4071554 | 3/1992 | Japan | 135/67 |
| 1771736 | 10/1992 | U.S.S.R. | 135/67 |

*Primary Examiner*—Richard J. Apley
*Assistant Examiner*—Jeanne M. Clark
*Attorney, Agent, or Firm*—Zarley, McKee, Thomte, Voorhees & Sease; Mark D. Frederiksen

[57] ABSTRACT

The rehabilitation therapy apparatus of the present invention includes a support bar cantilevered generally horizontally outwardly from a vehicle which is operable in a forward direction, the support bar being adjustably mounted for selective vertical adjustment on the vehicle. A frame with a horizontal arm is connected to the roof of the vehicle, while a vertical leg depends from the arm, upon which the support bar is adjustably connected. A tube mounted on the roof of the vehicle receives the frame arm on either end, to permit use of the arm on either side of the vehicle. The rehabilitation therapy includes the initial step of loosely strapping a patient's nonambulatory leg to the leg of a trainer such that movement of the trainer's leg will appropriately move the patient's leg. The therapy apparatus of the invention is then positioned with the support bar forwardly of the patient and trainer so that the patient and trainer may grip the bar for support. The vehicle is then moved forwardly while the patient and trainer walk along behind the support bar. This procedure is repeated until the patient gains control of the nonambulatory leg and can walk alone behind the support bar.

1 Claim, 2 Drawing Sheets

REHABILITATION APPARATUS IN COMBINATION WITH A MOTOR-DRIVEN VEHICLE

TECHNICAL FIELD

The present invention relates generally to apparatus and methods for rehabilitating people with physical disabilities requiring retraining for ambulatory movement. More particularly, the present invention provides an improved apparatus and method for training people to walk.

BACKGROUND OF THE INVENTION

Equine activities have been utilized as a form of therapy to achieve various physical, psychological, cognitive and behavioral goals. Physical and occupational therapists integrate therapeutic exercise techniques with the movement of the horse to stimulate unused or underused muscles. Horse riding has been found to be particularly beneficial for nonambulatory persons, who have no natural means of locomotion. The action of the horse relaxes and stimulates unused muscles, building muscle tone and improving coordination and balance.

It has been found that a horse's walking action mimics the body action. Thus, when a person is placed on a horse, in order to keep their balance they are forced to move their trunk, arms, shoulders, head and the rest of their body. The horse moves and the rider's muscles move in synchronization with it. A 1988 study published in the *Journal of the American Physical Therapy Association* reported that therapeutic riding improved muscle tone, balance, head control and posture in all children tested. Horse riding can also be an effective tool in assisting physical therapists in the treatment of neurological disorders. During a horse ride, the rider's pelvis moves in a precise pattern that is very similar to a person's pelvic movement during normal human gait. The repetitive input provides the brain with neuro-sensory information necessary for motor re-education.

The neuro-developmental treatment approach teaches that limb function is dependent upon the trunk. To accomplish positive changes within the trunk is challenging using traditional therapy techniques. The horse, however, is able to give repetitive, symmetrical input to the trunk. The movement during a horse ride mobilizes the pelvis, lumbar spine, and hip joints. While riding, equilibrium responses are facilitated and balance, postural muscle strength, and tone improves.

The organized sensory input received during the riding session provides improved body awareness and spatial orientation, while the interaction with the horse has tremendous psychological benefits that play an important role in rehabilitation.

While hippotherapy has proven effective as an initial therapy in regaining balance and improving muscle control, it does not assist a person in retraining their muscles to walk. There are other therapies currently utilized in ambulatory therapy, all of which have basic drawbacks. In one therapeutic method, a pair of parallel bars are utilized to support a person as they begin placing weight on their legs and retrain the legs to move in the appropriate sequence for walking. Another method utilizes a "walker" which again relies on the patient supporting the body and then lifting and moving the walker between steps.

Such ambulatory therapies do not readily teach the appropriate body movement for walking. Rather, they rely on supporting the body with the arms above the ground.

SUMMARY OF THE INVENTION

It is therefore a general object of the present invention to provide an improved apparatus and method for rehabilitating a person to become ambulatory.

Yet another object is to provide a rehabilitation therapy which mimics the human's natural gait in order to retrain the patient's muscles and brain to the appropriate motion for walking.

Still another object is to provide an improved rehabilitation apparatus which is mountable on a vehicle to lead a patient during therapy.

Yet a further object of the present invention is to provide a rehabilitation apparatus which is economical to manufacture, simple to adjust to every patient, and easy to use.

These and other objects will be apparent to those skilled in the art.

The rehabilitation therapy apparatus of the present invention includes a support bar cantilevered generally horizontally outwardly from a vehicle which is operable in a forward direction, the support bar being adjustably mounted for selective vertical adjustment on the vehicle. A frame with a horizontal arm is connected to the roof of the vehicle, while a vertical leg depends from the arm, upon which the support bar is adjustably connected. A tube mounted on the roof of the vehicle receives the frame arm on either end, to permit use of the arm on either side of the vehicle. The rehabilitation therapy includes the initial step of loosely strapping a patient's nonambulatory leg to the leg of a trainer such that movement of the trainer's leg will appropriately move the patient's leg. The therapy apparatus of the invention is then positioned with the support bar forwardly of the patient and trainer so that the patient and trainer may grip the bar for support. The vehicle is then moved forwardly while the patient and trainer walk along behind the support bar. This procedure is repeated until the patient gains control of the nonambulatory leg and can walk alone behind the support bar.

DESCRIPTION OF THE PREFERRED EMBODIMENT

Figure 1:
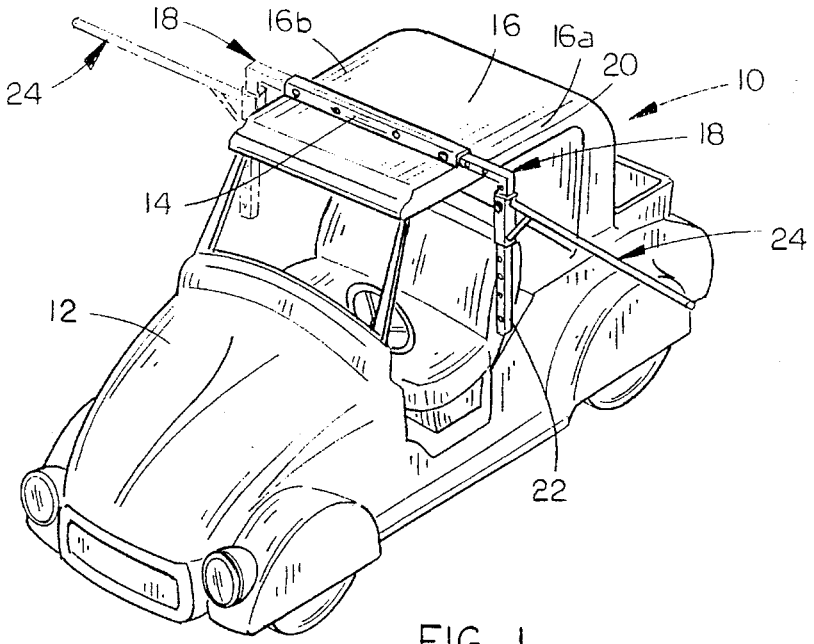
FIG. 1 is a perspective view of the therapy apparatus of the present invention installed on a vehicle.

Referring now to the drawings, in which similar or corresponding parts are identified with the same reference numeral and more particularly to FIG. 1, the rehabilitation therapy apparatus of the present invention is designated generally at 10 and is shown attached to a small vehicle 12. The vehicle 12 may be of any convenient type, such as an electric golf cart or the like.

Therapy apparatus 10 includes three major components. First, an elongated support tube 14 mounted generally transversely on roof 16 of vehicle 12, and extending from roof side edge **16*a* to side edge 16*b*. The second component of apparatus 10 is an L-shaped frame 18 having a horizontal arm 20 and a depending leg 22. Arm 20 of frame 18 is slidably journaled within support tube 14**, as described in more detail hereinbelow.

The third component of therapy apparatus 10 is a support apparatus 24 adjustably mounted on frame leg 22 for adjustable vertical movement.

Figure 3:
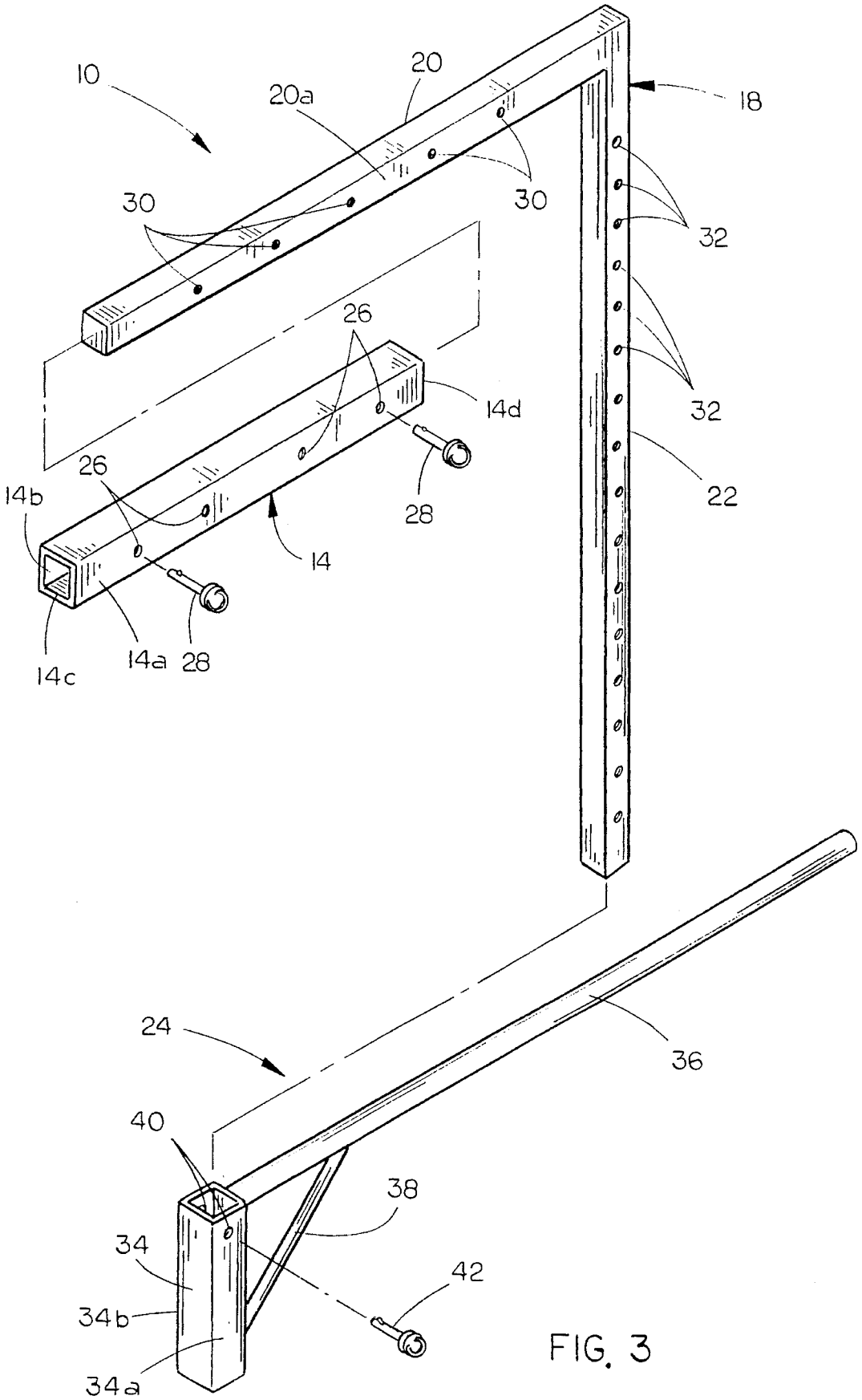
FIG. 3 is an exploded perspective view of the therapy apparatus of the present invention.

Referring now to FIG. 3, therapy apparatus 10 is shown in more detail. Support tube 14 is preferably square in cross-section with forward and rearward walls 14*a* and 14*b*. A plurality of apertures 26 are formed in forward wall 14*a* and uniformly spaced apart between the opposing ends 14*c* and 14*d*. A pair of selectively securable pins 28 may be selectively journaled through any one of apertures 26, to secure arm 20 of frame 18 within tube 14. A plurality of apertures 30 in a forward wall 20*a* of arm 20 are sized to receive pins 28 therethrough to secure arm 20 and prevent longitudinal movement through tube 14.

Apertures 26 also extend coaxially through rearward wall 14*b* of tube 14, to permit insertion of arm 20 into either end 14*c* or 14*d* of tube 14. Thus, as shown in FIG. 1, frame 18 may be adjustably secured within tube 14 from either end.

Leg 22 of frame 18 also includes a plurality of apertures 32 formed in the forward and rearward walls thereof and uniformly vertically spaced from the upper end to the lower end of leg 22.

Support apparatus 24 includes a vertically oriented sleeve 34 with a support bar 36 projecting horizontally from an upper end thereof. A cross-member 38 extends from the lower end of sleeve 34 to support bar 36, to provide additional structural support to the projecting support bar. A pair of coaxial apertures 40 are formed in forward and rearward walls 34*a* and 34*b* respectively and receive a lockable pin 42 therethrough. Apertures 32 in leg 22 of frame 18 are sized to receive pin 42 therethrough. Thus, sleeve 34 may be journaled on leg 22 and secured in one of a variety of vertical positions therealong. In addition, sleeve 34 may be inverted such that bar 36 extends from the lower end thereof, to permit adjustment of the bar at the lower end of leg 22.

While frame 18 is horizontal adjustable by virtue of arm 20 slidably secured within support tube 14, it is preferred to initiate any therapy with leg 22 retracted against the vehicle. For this reason, a bearing plate 39 is mounted on the side of the vehicle 12, to prevent damage to the vehicle side panels. In this retracted position, support bar 36 is much more stable, because of the points of support at both the upper and lower ends. Once a patient relies less on bar 36 for support, the frame 18 may be extended outwardly.

Figure 2:
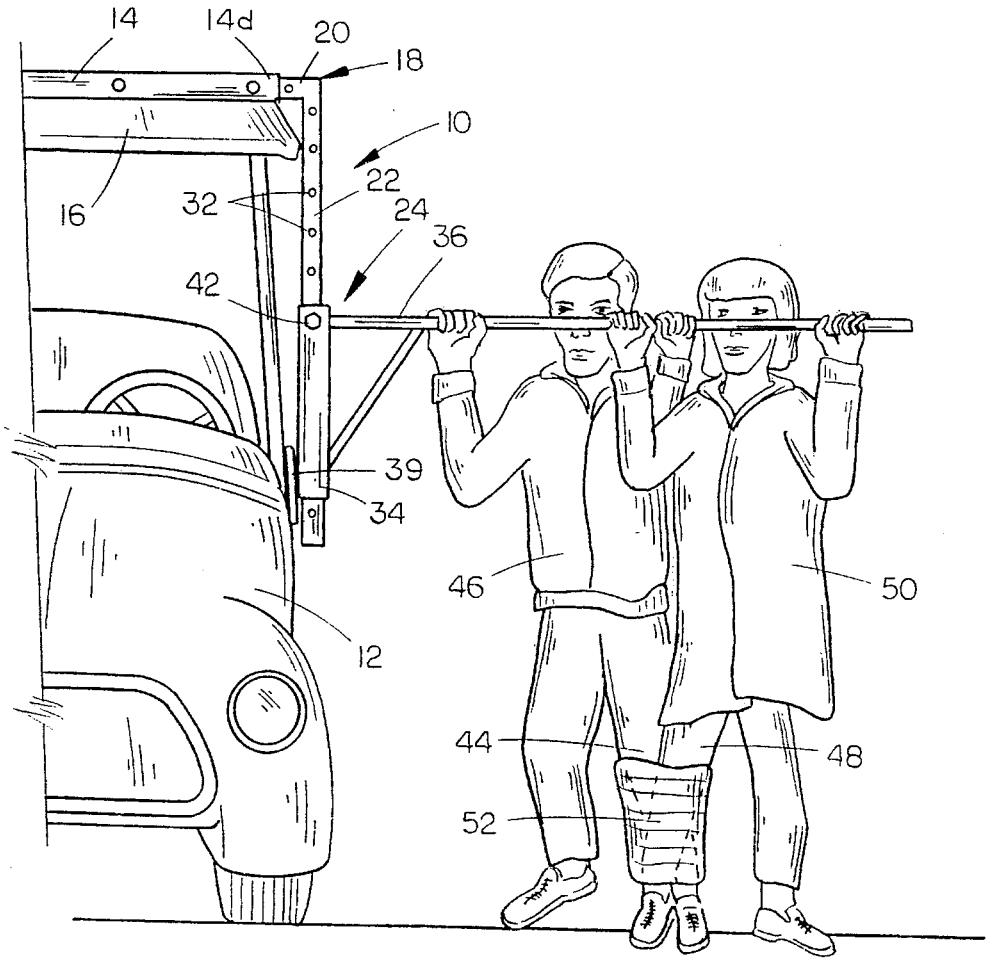
FIG. 2 is a front elevational view of the apparatus on a vehicle with a trainer and student using the method of the invention.

Referring now to FIGS. 1 and 2, the method of therapy of the present invention includes the initial step of utilizing hippotherapy to achieve muscle tone and coordination for walking. Once a patient is capable of supporting himself on his feet, the rehabilitation therapy apparatus 10 is attached to vehicle 12 with tube 14 mounted on roof 16. Horizontal arm 20 of frame 18 is then inserted in the desired end 14*c* or 14*d* of support tube 14, such that support apparatus 24 projects from the desired side of vehicle 12. As shown in FIG. 2, sleeve 34 is adjusted vertically by journaling pin 42 through the sleeve and into the desired aperture 32 on leg 22 of frame 18. Support bar 36 may thereby be positioned vertically above the ground for the particular person undergoing rehabilitation.

The initial step in utilizing therapy apparatus 10 includes loosely strapping the leg 44 of a patient 46 to the leg 48 of a trainer 50. As shown in FIG. 2, a sleeve 52 of elastic or fabric material is preferably utilized to connect legs 44 and 48, with the trainers leg located forwardly of the patient's leg. In this way, the trainer 50 will walk in a normal fashion, with the trainer's leg 48 lifting and positioning the patient's leg 44, to "retrain" the patient's brain to the appropriate ambulatory movement.

At the same time, bar 36 is positioned at a vertical height at approximately shoulder height of patient 46. This height is preferred so that the patient is led forwardly by movement of vehicle 12, but forces the patient to walk in a conventional fashion without supporting themselves on the arms. At the same time, the patient is readily able to catch themselves if they stumble in their ambulatory movement.

As patient 46 gains muscle control and stamina, longer and longer walks are provided, and trainer 50 will eventually remove sleeve 52 to permit patient 46 to walk alone.

Whereas the invention has been shown and described in connection with the preferred embodiment thereof, many modifications, substitutions and additions may be made which are within the intended broad scope of the appended claims.

I claim:

1. In combination:

a motor-driven vehicle having forward and rearward directions of travel; and a rehabilitation therapy apparatus projecting from said vehicle, said apparatus comprising:

a tube mounted on the vehicle, oriented perpendicularly to the direction of travel of the vehicle, said tube having opposing first and second open ends;

a frame with a horizontal arm slidably journaled within one of said first and second ends of the tube for selectively adjustable horizontal movement inwardly and outwardly relative to the vehicle, and a vertical leg rigidly affixed to and depending from an outer end of the arm, said support bar adjustably connected to the frame leg for selective vertical movement thereon;

means connected between the tube and frame arm for selectively locking the frame arm in a selected horizontal position in the tube;

a support bar having inward and outward ends, the inward end operably connected to the frame vertical leg for selective vertical movement thereon and the outward end cantilevered generally horizontally outwardly from said vehicle;

a vertically oriented sleeve mounted on the inward end of said support bar with said frame leg slidably journaled through said sleeve for adjustable vertical movement of the sleeve on the frame leg;

means connected between the frame leg and sleeve for selectively locking the sleeve in a selected position along the frame leg.

* * * * *